US011346187B2

(12) United States Patent
Greci et al.

(10) Patent No.: US 11,346,187 B2
(45) Date of Patent: May 31, 2022

(54) WELL SCREEN FOR USE WITH EXTERNAL COMMUNICATION LINES

(71) Applicant: Halliburton Energy Services, Inc., Houston, TX (US)

(72) Inventors: Stephen Michael Greci, Little Elm, TX (US); Liam Andrew Aitken, Bedford, TX (US); Austin Lee Wright, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 54 days.

(21) Appl. No.: 16/677,250

(22) Filed: Nov. 7, 2019

(65) Prior Publication Data

US 2021/0140281 A1 May 13, 2021

(51) Int. Cl.
*E21B 43/08* (2006.01)
*E21B 47/12* (2012.01)

(52) U.S. Cl.
CPC ..... *E21B 43/084* (2013.01); *E21B 43/086* (2013.01); *E21B 47/12* (2013.01)

(58) Field of Classification Search
CPC ..... E21B 43/08; E21B 43/084; E21B 43/086; E21B 47/12; E21B 43/082; E21B 43/10; E21B 43/108
See application file for complete search history.

(56) References Cited

U.S. PATENT DOCUMENTS

| | | | | |
|---|---|---|---|---|
| 6,136,589 | A | 10/2000 | Lim et al. | |
| 6,681,854 | B2 | 1/2004 | Danos | |
| 6,848,510 | B2 | 2/2005 | Bixenman et al. | |
| 7,584,799 | B2 | 9/2009 | Coronado et al. | |
| 7,802,622 | B2 * | 9/2010 | Roaldsnes | E21B 43/08 166/241.1 |
| 9,441,463 | B2 | 9/2016 | Cunningham et al. | |
| 2015/0375144 | A1 * | 12/2015 | Greci | B01D 29/111 29/896.61 |

* cited by examiner

*Primary Examiner* — D. Andrews
(74) *Attorney, Agent, or Firm* — K&L Gates LLP

(57) ABSTRACT

A well screen for a borehole. The well screen may include an arcuate outer shroud, a mesh layer, and a drainage layer. The arcuate outer shroud may include perforations, a first longitudinal end, and a second longitudinal end. The first and second longitudinal ends may be spaced arcuately apart such that a gap is formed between the first and the second longitudinal ends of the outer shroud. The mesh layer may restrict flow of particulate materials of a predetermined size from passing therethrough and is positioned radially inward from the outer shroud. The mesh layer may include a first and a second longitudinal end that are radially aligned with the first and the second longitudinal ends of the outer shroud to continue the gap. The drainage layer may be positioned radially inward from to the mesh layer and may include at least one of perforations or louvers.

20 Claims, 3 Drawing Sheets

WELL SCREEN FOR USE WITH EXTERNAL COMMUNICATION LINES

BACKGROUND

This section is intended to provide relevant background information to facilitate a better understanding of the various aspects of the described embodiments. Accordingly, it should be understood that these statements are to be read in this light and not as admissions of prior art.

It is well known in the subterranean well drilling and completion art that relatively fine particulate materials may be produced during the production of hydrocarbons from a well that traverses an unconsolidated or loosely consolidated formation. Numerous problems may occur as a result of the production of such particulate. For example, the particulate causes abrasive wear to components within the well, such as flow control devices, safety equipment, tubing and the like. In addition, the particulate may partially or fully clog the well creating the need for an expensive workover. Also, if the particulate matter is produced to the surface, it must be removed from the hydrocarbon fluids using surface processing equipment.

One method for preventing the production of such particulate material is to gravel pack the well adjacent to the unconsolidated or loosely consolidated production interval. In a typical gravel pack completion, well screens are lowered into the borehole as part of a completion string to a position proximate the desired production interval. A fluid slurry including a liquid carrier and a relatively coarse particulate material, such as sand, gravel or proppants which are typically sized and graded and which referred to herein as gravel, is then pumped down the work string and into the well annulus formed between the well screens and the perforated well casing or open hole production zone.

The liquid carrier either flows into the formation or returns to the surface by flowing through a wash pipe or both. In either case, the gravel is deposited around the well screens to form the gravel pack, which is highly permeable to allow the flow of hydrocarbon fluids but blocks the flow of the fine particulate materials carried in the hydrocarbon fluids. However, well screens are often designed to fill a majority of the borehole and accordingly do not provide clearance for downhole communication lines.

BRIEF DESCRIPTION OF THE DRAWINGS

Embodiments of the well screen are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes a well screen for use with external communication lines. The well screen prevents particulate material from entering a base pipe during well operations such as gravel pack operations, while providing an external pathway for communication lines.

A main borehole may in some instances be formed in a substantially vertical orientation relative to a surface of the well, and a lateral borehole may in some instances be formed in a substantially horizontal orientation relative to the surface of the well. However, reference herein to either the main borehole or the lateral borehole is not meant to imply any particular orientation, and the orientation of each of these boreholes may include portions that are vertical, non-vertical, horizontal or non-horizontal. Further, the term "uphole" refers a direction that is towards the surface of the well, while the term "downhole" refers a direction that is away from the surface of the well.

Figure 1:
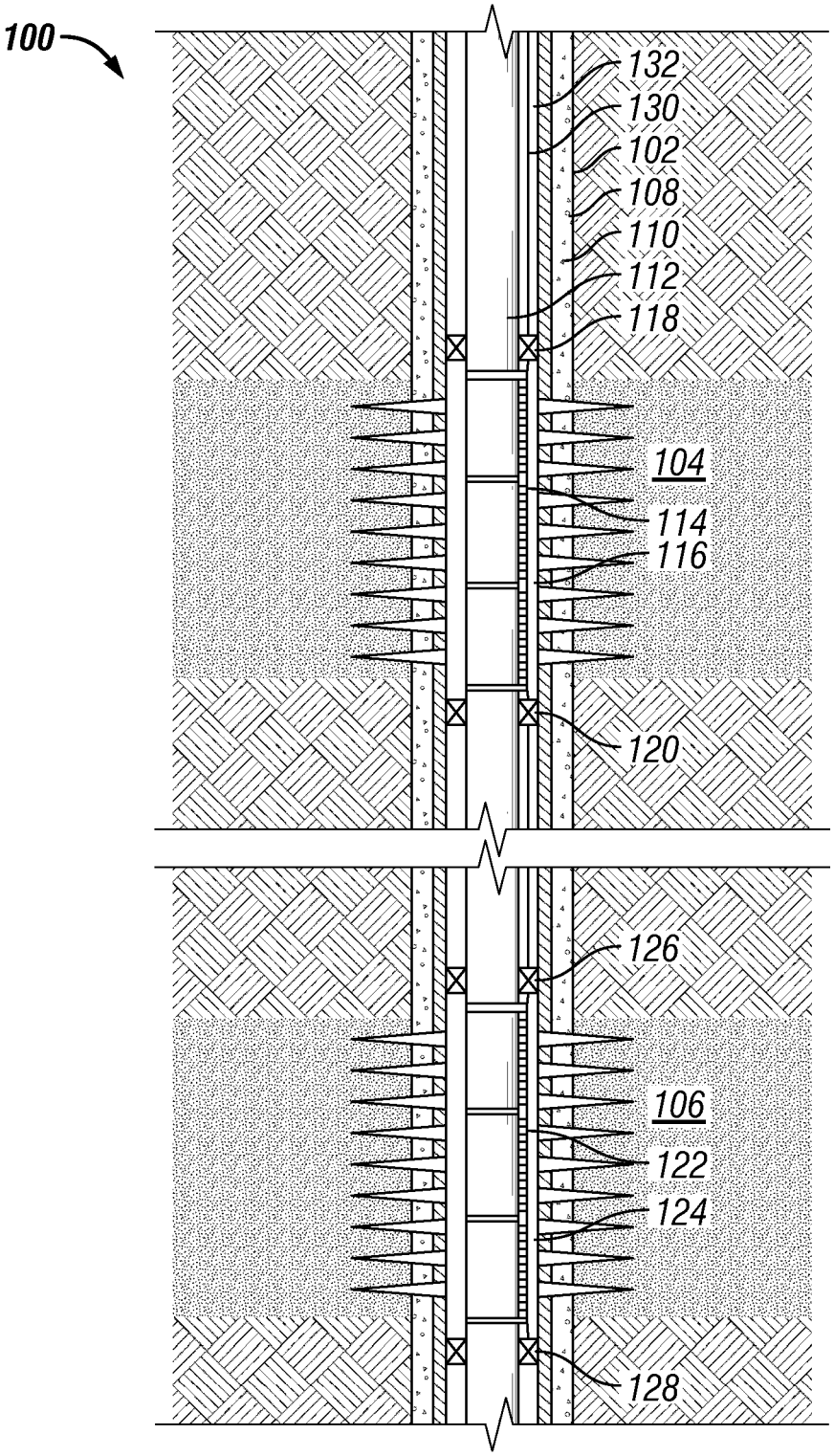
FIG. 1 is a cross-sectional diagram of a well system, according to one or more embodiments.

FIG. 1 is a cross-sectional diagram of a well system 100, according to one or more embodiments. A borehole 102 extends through the various earth strata including formations 104, 106. A casing 108 is supported within borehole 102 by cement 110. A completion string 112 includes various tools such as a well screen 114 that is positioned within production interval 116 between packers 118, 120. In addition, completion string includes a well screen 122 that is positioned within production interval 124 between packers 126, 128.

One or more communication lines 130, such as flow lines or control lines, extend from the surface within annulus 132 and pass through well screens 114, 122, as described in more detail below, to provide instructions, provide power, transmit signals and/or data, and transport operating fluid, such as hydraulic fluid or well fluid, to sensors, actuators, hydraulic sleeves, and other downhole devices. For example, the communication lines 130 may convey fluid to one or more of the packers 118, 120, 126, 128 to set the packers 118, 120, 126, 128 once the well screens reach the desired location within the borehole 102. Communication lines may also pass through the well screens 114, 122. The communication lines may be gravel pack tubes, clean fluid flow tubes, or dehydration tubes used in various downhole operations.

Once completion string 112 is positioned as shown within borehole 102, a fluid containing sand, gravel, proppants or the like may be pumped down completion string 112 such that formations 104, 106 and production intervals 116, 124 may be packed. The fluid is filtered through the well screens 114, 122 and returns to the surface through the completion string 112. Sensors operably associated with completion string 112 may be used to provide substantially real time data to the operator via communication line 130 on the effectiveness of the treatment operation such as identifying voids during the gravel placement process to allow the operator to adjust treatment parameters such as pump rate, proppant concentration, fluid viscosity and the like to overcome deficiencies in the gravel pack. In addition, such sensors may be used to provide valuable information to the operator via communication line 40 during the production phase of the well such as fluid temperature, pressure, velocity, constituent composition and the like such that the operator can enhance the production operations.

Even though FIG. 1 depicts well screens 114, 122 in a cased hole environment, it should be understood by those skilled in the art that the well screens 114, 122 are suited for use in open hole environments. Also, even though FIG. 1 depicts multiple well screens 114, 122 in each production interval, it should be understood by those skilled in the art that any number of well screens may be deployed within a production interval without departing from the principles of this disclosure.

Further, even though FIG. 1 depicts a vertical completion, it should be understood by those skilled in the art that the well screens 114, 122 are suited for use in well having other directional configurations including horizontal wells, deviated wells, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
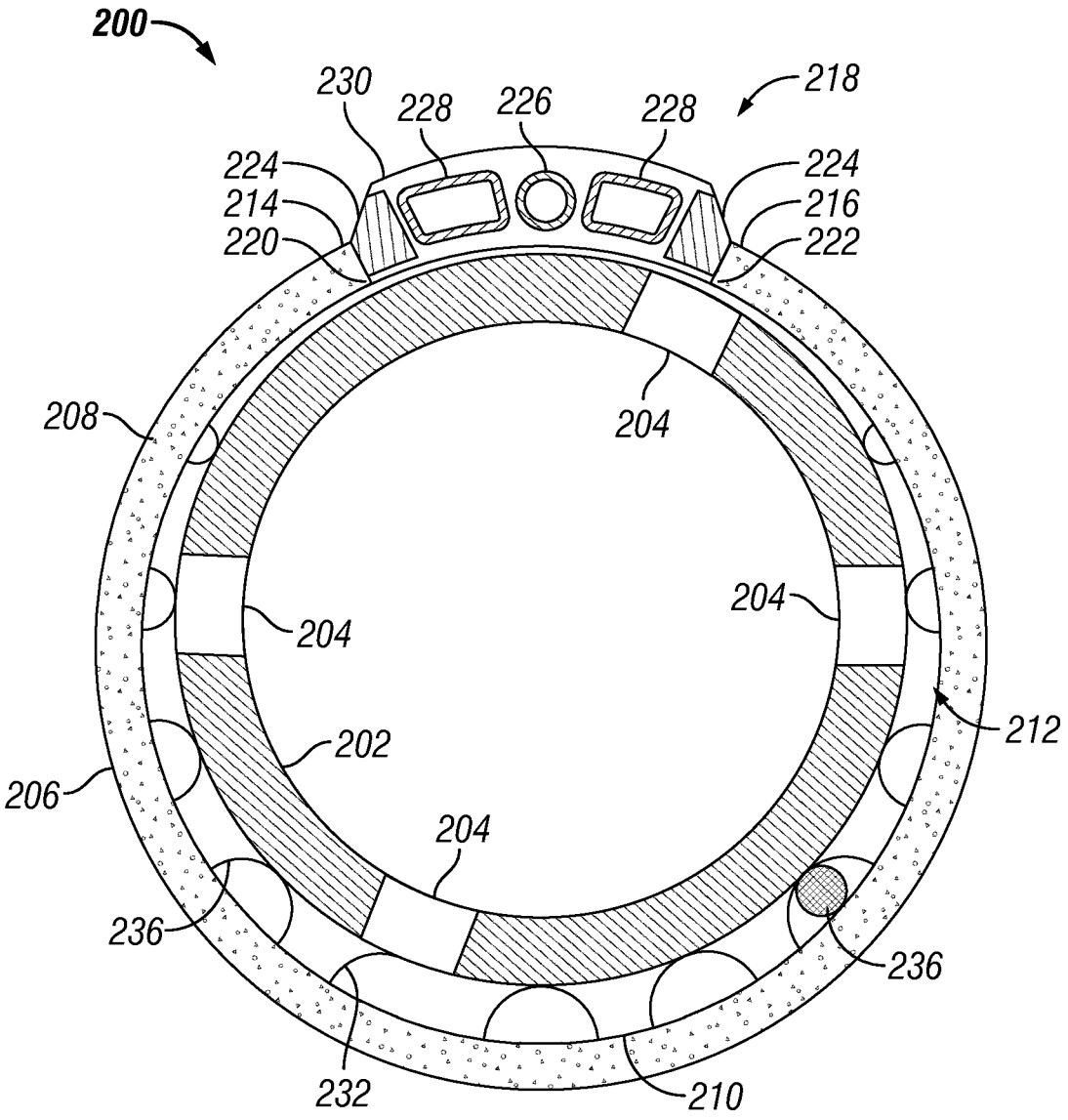
FIG. 2 is a cross-sectional diagram of a well screen, according to one or more embodiments.

Referring now to FIG. 2, FIG. 2 is a cross-sectional diagram of a well screen, according to one or more embodiments. As shown in FIG. 2, the well screen 200 is positioned around a perforated base pipe 202 that makes up a portion of a completion string 112. The perforations 204 in the base pipe 202 allow fluid filtered by the well screen 200 to enter the completion string 112 and return to the surface. Although only four perforations 204 in the base pipe 202 are shown, the base pipe 202 may be perforated at any location and with any number of perforations around the circumference of the base pipe 202.

The well screen 200 includes an outer shroud 206, a mesh layer 208, and a drainage layer 210 that surround the base pipe. In at least one embodiment, the well screen 200 is formed prior to being placed on the base pipe 202. The well screen 200 is then installed on the base pipe prior to the base pipe 202 being run downhole. In other embodiments, the well screen 200 is formed in place on the base pipe 202.

Figure 3:
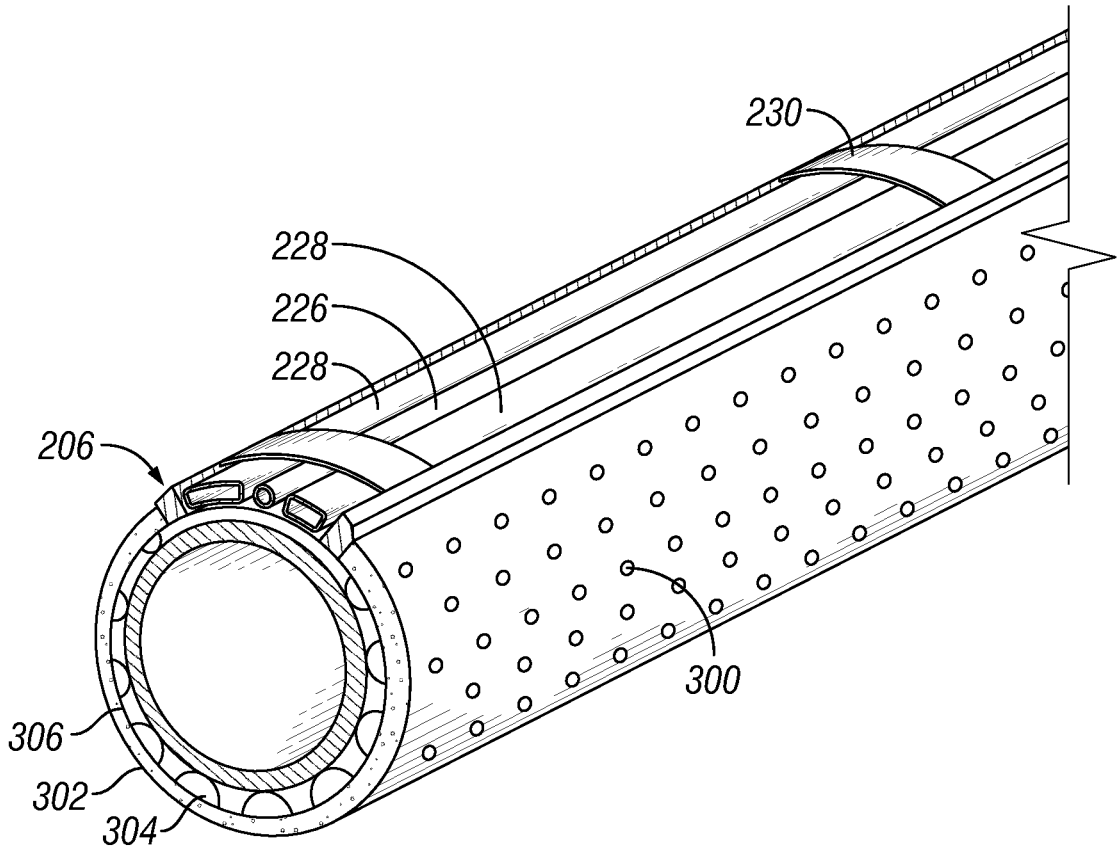
FIG. 3 is an isometric, cross-sectional diagram of the well screen of FIG. 2.

As shown in more detail in FIG. 3, the outer shroud 206 includes perforations 300 to allow fluid to flow through the outer shroud 206 and into the mesh layer 208. The outer shroud 206 may also include stand-offs (not shown) similar to drainage layer stand-offs 212 described in more detail below. The outer shroud 206 stand-offs create a flowpath between the outer shroud 206 and the mesh layer 208.

Referring back to FIG. 2, a first end 214 and a second end 216 of the outer shroud 206 are spaced arcuately apart so that a gap 218 is formed in the well screen 200. The outer shroud 206 is coupled to the mesh layer 208. In at least one embodiment, the outer shroud 206 and the mesh layer 208 may be coupled together through welding, adhesives, mechanical swaging, or similar means along the first end 214 of the outer shroud 206 and a first end 220 of the mesh layer 208, and a second end 216 of the outer shroud 206 and a second end 222 of the mesh layer 208. In other embodiments, the axial ends 302, 304 of the outer shroud 206 and the mesh layer 208, shown in FIG. 3, may be coupled together. Additionally, the axial ends 304, 306 of the mesh layer 208 and the drainage layer 210 are sealed via welding, adhesives, mechanical swaging, or similar means prevent unfiltered fluid from entering the base pipe 202.

The mesh layer 208 may be a single layer or multiple layers of mesh that include apertures sized to filter particulate material from the fluid before the fluid enters the base pipe 202. The individual layers of mesh may be formed through weaving or other methods known to those skilled in the art. The layers may then be woven together, sintered together, or stacked on top of each other to form the mesh layer 208. As shown in FIG. 2, the first end 220 and the second end 222 of the mesh layer 208 are radially aligned with the first end 214 and the second end 216 of the outer shroud 206 to form the gap 218 in the well screen 200.

In the exemplary embodiment, the first ends 214, 220 and the second ends 216, 222 of the outer shroud 206 and the mesh layer 208 are each coupled to a bumper 224, as shown in FIG. 2, through welding, adhesives, mechanical swaging, or similar means. The bumpers 224 run along the axial length of the well screen 200 and act as a seal for the first end 220 and the second end 222 of the mesh layer 208. In other embodiments, the bumpers 224 may be omitted and the first end 220 and the second end 222 of the mesh layer 208 may otherwise be sealed using methods known to those skilled in the art.

The bumpers 224 may extend radially beyond the outer shroud 206 to prevent damage to communication lines, such as control line 226 and flow lines 228, that pass through the gap 218 formed in the well screen 200. In other embodiments, the bumpers 224 may be omitted. Although the exemplary embodiment depicts three communication lines, including one control line 226 and two flow lines 228, the well screen is not thereby limited. In other embodiments, the communication line or lines may include any number of control lines 226, flow lines 228, or combinations of control lines 226 and flow lines 228 passing through the gap 218 formed in the well screen 200. In at least one embodiment, one or more straps 230 may be used to retain the communication lines 226, 228 in the gap 218.

As shown in FIG. 2, the bumpers 224 and/or the mesh layer 208 are coupled to the drainage layer 210 through welding, adhesives, mechanical swaging, or similar means that create a seal between drainage layer 210 and the first end 220 and the second end 222 of the mesh layer 208. The drainage layer 210 includes perforations, similar to the perforations 300 in the outer shroud 206, and/or louvers 232 formed in the drainage layer 210 to allow fluid to pass from the mesh layer 208 to the base pipe 202. In some embodiments, the drainage layer 210 does not include any perforations or louvers in the arcuate area radially inward from the gap 218. In other embodiments, the arcuate area radially inward from the gap 218 may include perforations that are sized to provide the same filtration as the mesh layer 208.

The drainage layer 210 also includes multiple stand-offs 212 that extend radially inward from the drainage layer 210 and contact the base pipe 202. The stand-offs 212 create flowpaths for the fluid so the fluid can enter the perforations 204 in the base pipe 202. The louvers 232 formed in the drainage layer 210 function as the stand-offs 212, as well as allowing fluid to pass through the drainage layer 210. Dimples 234 may also formed in the drainage layer 210 or sections of rods 236 are attached to the drainage layer 210 to create the stand-offs 212. Although the exemplary embodiment includes louvers 232, dimples 234, and sections of rods 236, other embodiments may include only louvers 232, only dimples 234, only sections of rods 236, or any combination thereof.

In the exemplary embodiment, the stand-offs 212 extend further inward as the arcuate distance between the respective stand-off 212 and the gap 218 increases such that the stand-offs opposite the gap extend the furthest inward. In other embodiments, the stand-offs 212 may extend a uniform distance inward.

Further examples include:

Example 1 is a well screen for a borehole. The well screen includes an arcuate outer shroud, a mesh layer, and a drainage layer. The drainage layer includes perforations, a first longitudinal end, and a second longitudinal end. The first longitudinal end and the second longitudinal end are spaced arcuately apart such that a gap is formed between the first longitudinal end of the outer shroud and the second longitudinal end of the outer shroud. The mesh layer restricts flow of particulate materials of a predetermined size from passing therethrough. The mesh layer is positioned radially inward from the outer shroud and includes a first longitudinal end that is radially aligned with the first longitudinal end of the outer shroud and a second longitudinal end that is radially aligned with the second longitudinal end of the outer shroud to continue the gap. The drainage layer is positioned radially inward from to the mesh layer and includes at least one of perforations or louvers.

In Example 2, the embodiments of any preceding paragraph or combination thereof further include a first bumper and a second bumper. Each bumper is coupled to the drainage layer and extends along an axial length of the well screen. The first bumper is coupled to the first longitudinal end of the outer shroud and the first longitudinal end of the mesh layer. The second bumper is coupled to the second longitudinal end of the outer shroud and the second longitudinal end of the mesh layer.

In Example 3, the embodiments of any preceding paragraph or combination thereof further include wherein the drainage layer includes perforations and stand-offs extending radially inward from the drainage layer, the stand-offs including at least one of dimples formed into the drainage layer or sections of rods coupled to the drainage layer.

In Example 4, the embodiments of any preceding paragraph or combination thereof further include wherein the stand-offs extend further inward as the arcuate distance between the respective stand-off and the gap increases such that the stand-offs opposite the gap extend the furthest inward.

In Example 5, the embodiments of any preceding paragraph or combination thereof further include wherein the drainage layer is not perforated in an arcuate area radially inward from the gap.

In Example 6, the embodiments of any preceding paragraph or combination thereof further include wherein the perforations in an arcuate area radially inward from the gap are sized to provide the same restriction of flow of the particulate materials of the predetermined size as the mesh layer.

In Example 7, the embodiments of any preceding paragraph or combination thereof further include wherein the drainage layer includes louvers forming stand-offs extending radially inward from the drainage layer and wherein no louvers are formed in an arcuate area radially inward from the gap.

In Example 8, the embodiments of any preceding paragraph or combination thereof further include wherein the stand-offs extend further inward as the arcuate distance between the respective stand-off and the gap increases such that the stand-offs opposite the gap extend the furthest inward.

In Example 9, the embodiments of any preceding paragraph or combination thereof further include a strap extending across the arcuate gap.

Example 10 is a completion system for a borehole. The completion system includes a perforated base pipe and a well screen surrounding the perforated base pipe. The well screen includes an arcuate outer shroud, a mesh layer, and a drainage layer. The drainage layer includes perforations, a first longitudinal end, and a second longitudinal end. The first longitudinal end and the second longitudinal end are spaced arcuately apart such that a gap is formed between the first longitudinal end of the outer shroud and the second longitudinal end of the outer shroud. The mesh layer restricts flow of particulate materials of a predetermined size from passing therethrough. The mesh layer is positioned radially inward from the outer shroud and includes a first longitudinal end that is radially aligned with the first longitudinal end of the outer shroud and a second longitudinal end that is radially aligned with the second longitudinal end of the outer shroud to continue the gap. The drainage layer is positioned radially inward from to the mesh layer and includes at least one of perforations or louvers.

In Example 11, the embodiments of any preceding paragraph or combination thereof further include wherein the well screen includes a first bumper and a second bumper. Each bumper is coupled to the drainage layer and extends along an axial length of the well screen. The first bumper is coupled to the first longitudinal end of the outer shroud and the first longitudinal end of the mesh layer. The second bumper is coupled to the second longitudinal end of the outer shroud and the second longitudinal end of the mesh layer.

In Example 12, the embodiments of any preceding paragraph or combination thereof further include wherein the drainage layer includes stand-offs extending radially inward from the drainage layer, the stand-offs including at least one of dimples formed into the drainage layer and sections of rods coupled to the drainage layer.

In Example 13, the embodiments of any preceding paragraph or combination thereof further include wherein the stand-offs extend further inward as the arcuate distance between the respective stand-off and the gap increases such that the stand-offs opposite the gap extend the furthest inward.

In Example 14, the embodiments of any preceding paragraph or combination thereof further include wherein the drainage layer is not perforated in the same arcuate area radially inward from the gap.

In Example 15, the embodiments of any preceding paragraph or combination thereof further include casing positioned between the borehole and the outer shroud.

In Example 16, the embodiments of any preceding paragraph or combination thereof further include wherein the drainage layer includes louvers forming stand-offs extending radially inward from the drainage layer and wherein no louvers are formed in an arcuate area radially inward from the gap.

In Example 17, the embodiments of any preceding paragraph or combination thereof further include wherein the stand-offs extend further inward as the arcuate distance between the respective stand-off and the gap increases such that the stand-offs opposite the gap extend the furthest inward.

In Example 18, the embodiments of any preceding paragraph or combination thereof further include a communication line positioned in the gap of the well screen and in communication with a downhole device.

Example 19 is a method of producing hydrocarbons from a formation. The method includes installing a well screen and perforated base pipe within a borehole formed in the formation. The well screen includes an arcuate outer shroud, a mesh layer, and a drainage layer. The drainage layer includes perforations, a first longitudinal end, and a second longitudinal end. The first longitudinal end and the second longitudinal end are spaced arcuately apart such that a gap is formed between the first longitudinal end of the outer shroud and the second longitudinal end of the outer shroud. The mesh layer restricts flow of particulate materials of a predetermined size from passing therethrough. The mesh layer is positioned radially inward from the outer shroud and includes a first longitudinal end that is radially aligned with the first longitudinal end of the outer shroud and a second longitudinal end that is radially aligned with the second longitudinal end of the outer shroud to continue the gap. The drainage layer is positioned radially inward from to the mesh layer and includes at least one of perforations or louvers. The method also includes running a communication line through the gap of the well screen. The method further includes pumping a particulate slurry from the surface through an annulus formed between the borehole and the well screen.

In Example 20, the embodiments of any preceding paragraph or combination thereof further include controlling a downhole device via the communication line.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A well screen for use with a perforated base pipe to be positioned in a borehole, the well screen comprising:

an arcuate outer shroud comprising perforations, the outer shroud comprising a first longitudinal end and a second longitudinal end spaced arcuately apart such that a gap is formed between the first longitudinal end of the outer shroud and the second longitudinal end of the outer shroud;

a mesh layer that restricts flow of particulate materials of a predetermined size from passing therethrough, the mesh layer positioned radially inward from the outer shroud, the mesh layer comprising a first longitudinal end that is radially aligned with the first longitudinal end of the outer shroud and a second longitudinal end that is radially aligned with the second longitudinal end of the outer shroud to continue the gap; and a cylindrical drainage layer, having a circular cross-section and circumferentially surrounding the perforated base pipe and positioned radially inward from to the mesh layer and comprising stand-offs extending radially inward towards the perforated base pipe such that the perforated base pipe is eccentrically supported within the drainage layer closer to the gap by the stand-offs.

2. The well screen of claim 1, further comprising a first bumper and a second bumper, wherein:

each bumper is coupled to the drainage layer and extends along an axial length of the well screen;

the first bumper is coupled to the first longitudinal end of the outer shroud and the first longitudinal end of the mesh layer; and the second bumper is coupled to the second longitudinal end of the outer shroud and the second longitudinal end of the mesh layer.

3. The well screen of claim 1, wherein the drainage layer comprises perforations and the stand-offs comprise at least one of dimples formed into the drainage layer or sections of rods coupled to the drainage layer.

4. The well screen of claim 3, wherein the stand-offs extend further radially inward to contact the perforated base pipe as an arcuate distance between the respective stand-off and the gap increases such that the stand-offs opposite the gap extend the furthest inward.

5. The well screen of claim 3, wherein the drainage layer is not perforated in an arcuate area radially inward from the gap.

6. The well screen of claim 3, wherein the perforations in an arcuate area radially inward from the gap are sized to provide the same restriction of flow of the particulate materials of the predetermined size as the mesh layer.

7. The well screen of claim 1, wherein the drainage layer comprises louvers forming stand-offs and wherein no louvers are formed in an arcuate area radially inward from the gap.

8. The well screen of claim 7, wherein the stand-offs extend further inward as an arcuate distance between the respective stand-off and the gap increases such that the stand-offs opposite the gap extend the furthest inward.

9. The well screen of claim 7, wherein the well screen is formed prior to being placed on the perforated base pipe.

10. A completion system for a borehole, the completion system comprising:

a perforated base pipe; and a well screen surrounding the perforated base pipe, the well screen comprising:

an arcuate outer shroud comprising perforations, the outer shroud comprising a first longitudinal end and a second longitudinal end spaced arcuately apart such that a gap is formed between the first end of the outer shroud and the second end of the outer shroud;

a mesh layer that restricts flow of particulate materials of a predetermined size from passing therethrough, the mesh layer coupled to and positioned radially inward from the outer shroud, the mesh layer comprising a first longitudinal end that is radially aligned with the first longitudinal end of the outer shroud and a second longitudinal end that is radially aligned with the second longitudinal end of the outer shroud; and a cylindrical drainage layer, having a circular cross-section and circumferentially surrounding the perforated base pipe and positioned radially inward from the mesh layer and comprising stand-offs extending radially inward towards the perforated base pipe such that the perforated base pipe is eccentrically supported within the drainage layer closer to the gap by the stand-offs.

11. The completion system of claim 10, wherein:

the well screen further comprises a first bumper and a second bumper;

each bumper is coupled to the drainage layer and extends along an axial length of the well screen;

the first bumper is coupled to the first longitudinal end of the outer shroud and the first longitudinal end of the mesh layer; and the second bumper is coupled to the second longitudinal end of the outer shroud and the second longitudinal end of the mesh layer.

12. The completion system of claim 10, wherein the stand-offs comprise at least one of dimples formed into the drainage layer and sections of rods coupled to the drainage layer.

13. The completion system of claim 12, wherein the stand-offs extend further radially inward towards the perforated base pipe as an arcuate distance between the respective stand-off and the gap increases such that the stand-offs opposite the gap extend the furthest inward.

14. The completion system of claim 12, wherein the drainage layer is not perforated in the same arcuate area radially inward from the gap.

15. The completion system of claim 10, further comprising casing positioned between the borehole and the outer shroud.

16. The completion system of claim 10, wherein the drainage layer comprises louvers forming stand-offs and wherein no louvers are formed in an arcuate area radially inward from the gap.

17. The completion system of claim 16, wherein the stand-offs extend further inward as an arcuate distance between the respective stand-off and the gap increases such that the stand-offs opposite the gap extend the furthest inward.

18. The completion system of claim 10, further comprising a communication line positioned in the gap of the well screen and in communication with a downhole device.

19. A method of producing hydrocarbons from a formation, the method comprising:

installing a well screen and perforated base pipe within a borehole formed in the formation, the well screen comprising:

an arcuate outer shroud comprising perforations, the outer shroud comprising a first longitudinal end and a second longitudinal end spaced arcuately apart such that a gap is formed between the first longitudinal end of the outer shroud and the second longitudinal end of the outer shroud;

a mesh layer that restricts flow of particulate materials of a predetermined size from passing therethrough, the mesh layer coupled to and positioned radially inward from the outer shroud, the mesh layer comprising a first longitudinal end that is radially aligned with the first longitudinal end of the outer shroud and a second longitudinal end that is radially aligned with the second longitudinal end of the outer shroud; and a cylindrical drainage layer, having a circular cross-section and circumferentially surrounding the perforated base pipe and positioned radially inward from to the mesh layer and comprising stand-offs extending radially inward towards the perforated base pipe such that the perforated base pipe is eccentrically supported within the drainage layer closer to the gap by the stand-offs;

running a communication line through the gap of the well screen; and pumping a particulate slurry from a surface through an annulus formed between the borehole and the well screen.

20. The method of claim 19, further comprising controlling a downhole device via the communication line.

* * * * *